United States Patent [19]

McGraw et al.

[11] Patent Number: 5,065,996

[45] Date of Patent: Nov. 19, 1991

[54] DISK STACKER INCLUDING MOVABLE GATE FOR INSERTION OF SHEETS INTO DISK SLOTS

[75] Inventors: Thomas C. McGraw, Macedon; Randall E. Van Ryne, Rochester; Richard F. Scarlata, Greece; Cho Y. Sze, Fairport, all of N.Y.

[73] Assignee: Xerox Corporastion, Stamford, Conn.

[21] Appl. No.: 568,782

[22] Filed: Aug. 17, 1990

[51] Int. Cl.[5] ..... B65H 29/40

[52] U.S. Cl. ..... 271/176; 271/187; 271/315

[58] Field of Search ..... 271/187, 315, 176

[56] References Cited

U.S. PATENT DOCUMENTS

| | | | |
|---|---|---|---|
| 4,088,314 | 5/1978 | Phillips . | |
| 4,244,565 | 1/1981 | Geier | 271/315 X |
| 4,385,756 | 5/1983 | Beery . | |
| 4,431,177 | 2/1984 | Beery et al. . | |
| 4,575,069 | 3/1986 | Burkhart . | |
| 4,925,173 | 5/1990 | Lindblom | 271/315 X |

FOREIGN PATENT DOCUMENTS

| | | |
|---|---|---|
| 6215301 | 7/1987 | Japan . |
| 2082550 | 3/1982 | United Kingdom . |

*Primary Examiner*—Richard A. Schacher

*Attorney, Agent, or Firm*—Oliff & Berridge

[57] ABSTRACT

A movable gate is provided adjacent an input position of a slotted rotatable disk for aiding in the insertion of sheets into the disk slot(s). The movable gate moves between a first position and a second position wherein the first position is closer to the disk than the second position. When in the first position, the movable gate contacts and directs the leading portion of a sheet into the disk slot. When in the second position, the movable gate does not contact the sheet. The gate is moved to the second position at least while the trailing portion of the sheet passes thereunder so that the sheet does not slow down after exiting a pair of input rollers located upstream thereof and so that the trailing portion of the sheet is free to contact an overhead trail edge transport belt.

15 Claims, 8 Drawing Sheets

DISK STACKER INCLUDING MOVABLE GATE FOR INSERTION OF SHEETS INTO DISK SLOTS

Cross-reference is made to the foll applications of the same assignee which are filed concurrently herewith and disclose the same basic disk stacker system: U.S. Pat. Application No. 07/569,003, filed Aug. 17, 1990 and entitled "Disk Stacker Including Trail Edge Transport Belt for Stacking Short and Long Sheets"; U.S. Pat. Application No. 07/568,757, filed Aug. 17,1990 and entitled "Disk Stacker Including Registration Assist Device"; U.S. Pat. Application No. 07/568,722, filed Aug. 17, 1990 and entitled "Disk Stacker Including Tamping Mechanism Capable of Cross-Direction Offsetting"; and U.S. Pat. Application No. 07/568,736, filed Aug. 17, 1990 and entitled "Disk Stacker Including Wiping Member for Registration Assist".

BACKGROUND OF THE INVENTION

1. Field of the Invention

The present invention relates to apparatus for stacking sheets, and in particular, sheets issuing from a copier or printer.

2. Description of Related Art

In many automatic copying machines, the geometry of the machine elements is such that with the paper path the copies produced have the image on the top side. Thus sequential copies enter the collecting tray with the copy or image side up. This is satisfactory if only a single copy of a single image is desired or if multiple copies of a single image is desired. In both cases, no distinction between sequential copies is required and all copies may be readily collected with the image side up. It is also satisfactory if the original documents fed to the copying machine are fed in reverse order, last or bottom sheet first and first or top sheet last. In this instance the collected set has the top sheet face up on top and the bottom sheet face up on the bottom of the set. However, in most instances of copying set of documents, the set is face up with top sheet on the top and if copied according to normal procedures, the top sheet number one is copied, producing a copy face up and a set so produced has sheet number one face up on the bottom and the last sheet face up on the top. It can therefore be seen that it is desired to obtain the copies in the same order as the original set so that in the set produced by the copying machine the last sheet is on the bottom of the set and the top sheet is on the top of the set, both being face up. In addition, in electronic printing it is also advantageous to be able to print from the first page to the last page in order since if you print from the last sheet to the first sheet the substance of the first to last pages must be stored in the printer's memory thereby increasing the size and cost of the memory required.

This result may be accomplished in copying a set of sheets if the top sheet, number one sheet, is fed first to be copied and the copy produced which is image side up is inverted such that the image is on the bottom side. With copying of successive sheets of a set and inverting each copy the final set is collected face down with the top sheet on the bottom and the bottom sheet on the top.

It is also desirable to provide a system which is capable of inverting and stacking sheets which are supplied at a high speed and/or have a variety of different sizes and weights Such a system should be capable of registering sheets in a stack so that the front and side edges of each sheet are precisely aligned. A sheet stacking apparatus should also have the ability to offset sets of documents, so as to distinguish individual sets from one another, while maintaining a high degree of alignment of the sheets within each set.

U.S. Pat. No. 3,968,960 to Fedor et al discloses a sheet inverting and stacking apparatus. The apparatus comprises a conveying means, a rotating means for deflecting the leading edge of a sheet from the conveyor means to a stacking platform, a control means for altering the movement of the deflecting means in accordance with the length of the sheet, and a second conveying means above the deflector for moving the trailing portion of the sheet beyond the leading edge to aid in inverting the sheet onto the stacking platform. An overhead assist belt is provided which travels at the main paper path speed for assisting in flipping sheets. The rotation of the disk can be paused for longer sheets. Continuously rotating rolls having a friction surface on their periphery are used to urge the leading edges of deposited sheets onto the stack.

U.S. Pat. No. 4,431,178 to Kokubo et al discloses a bank note accumulator assembly for receiving bank notes. The assembly includes a plurality of paddle wheels, a conveyor, and a guide belt assembly which restrains the free movement of the trailing ends of paper sheets from slipping out of the paddle wheels. The guide belt is disposed at an angle to a carrier plate and moves at a speed substantially the same as the circumferential speed of the trailing free ends of the paddlewheels. A scraper plate is disposed below the paddlewheels for scraping the bank notes from the paddlewheels and into the carrier plate.

U.S. Pat. No. 4,575,069 to Burkhart discloses a sheet feeding mechanism comprising a pivoting deflector arm which deflects the leading edge of a sheet to a front portion of a receiving tray and then forms a buckle in the sheet, the deflector arm moving to a remote location after buckle formation, and a plurality of sheet feeding belts which frictionally feed the remaining portion of the sheet, allowing it to fall to the tray. See FIGS. 2–6. When inversion is not desired, the deflector arm is rotated to the remote position U.S Pat. No. 3,162,439 to poland et al discloses a document stacking device which includes a pair of slotted, rotating disks which receive, invert and stack documents. A series of rollers located above the disks assist in feeding a document into the disks as the disks rotate from an initial input position.

U.S Pat. No. 4,436,301 to Doery et al discloses an overhead transport for transporting a document to a position above a document stacking tray in a recirculating document handler.

A variety of other disk stacking devices have been proposed. U.S. Pat. No. 4,712,785 to Stemmle shows a disk stacker including an upstream deflector gate for selectively deflecting documents into the disk for inversion or through a bypass for stacking on the same tray without inversion. Xerox Disclosure Journal Vol. 12, No. 3 (May/June 1987) to Stemmle shows the same arrangement described above. U.S. Pat. No. 3,904,192 to Pfeifer et al shows a disk stacker located at the output slot of a copying machine. JA 63-123754 to Asano shows a stacker for inverting and stacking bills. JA 62-153051 to Uchiumi shows a sheet stacking device which employs a conveying belt to ensure complete entry of a sheet to stacked into the blades of an impeller. European Patent Application EP 59,101 A1 to Ariga et al and European Patent Specification EP 121,499 Bl to Nakamura disclose devices for stacking sheets wherein a predetermined number of notes are accumulated and stacked.

U.S. Pat. No. 4,385,756 as well as U.K. Patent Application No. GB 2,082,550A, both to Beery, disclose a disk stacker which includes a fixed sheet guide which assists in guiding sheets into the disk slots.

U.S. Pat. No. 4,088,314 to Phillips discloses a synchronous stacking device having a rotatable carrier with pockets. FIG. 2 shows a stacking device including a carrier comprising slotted disks. A guide track comprising wires is provided and is capable of being moved by a solenoid from a normal position to a deflecting position for deflecting a document which is not aligned with a slot.

U.S. Pat. No. 4,252,309 to Garrison et al discloses a spring-biased clamping member which secures a sheet within the slotted grooves of an inverting wheel during a sheet-inverting rotation. An edge clamp toggles along pins between two positions to secure the leading edge of a copy sheet within tapered slots of a rotating flipper roller. An angled flat spring presses against a cam surface to cause the clamp to engage (position B) and then disengage (position C) to hold and then release a sheet during a stacking process.

U.S. Pat. No. 4,600,186 to von Hein et al discloses a mechanism for reducing the impact speed of printing products as they enter into the pockets of a rotary delivery flywheel. The speed reduction mechanism includes a cam plate mounted adjacent the periphery of a rotary sheet delivery flywheel. The cam plate rotates in a direction opposite to the flywheel. Cams mounted on the cam plate rotate into closely spaced relation to rotatable fixed support rings to catch a trail edge of a printing product as it is being fed into a slot of the flywheel.

U.K. Patent No. 1,464,132 to Brooke discloses an engaging mechanism which grips the leading edge of an envelope as a drum rotates through a series of electrostatic reproduction stations.

U.S. Pat. No. 4,431,177 to Beery et al discloses a disk stacker which includes a pivotally mounted arm which moves an offset registration member in a direction to selectively offset sheets in the rotating disk.

U.S. Pat. No. ∝,568,172 to Acquaviva discloses a copier which outputs a stack of sheets wherein individual sets in the stack are offset in the process direction.

A number of devices for tamping one or more edges of a sheet stack to improve the registration thereof are known. Examples of tamping devices include those disclosed in U.S. Pat. Nos. 4,318,541; 4,147,342; 3,933,352; 3,733,070; 3,982,751; 4,556,211; and 4,844,440.

U.S. Pat. No. 3,847,388 to Lynch discloses a device for stacking sheets of cut material in alignment within a collecting tray. An extended flapper element of elastomeric resilient material is coaxially aligned with one of a pair of cooperating pinch rollers arranged to deliver sheets into a collecting tray. The flapper is deformed into a load condition as it is drawn into the nip formed between the cooperating rolls and, upon passing through the nip, is released against the uppermost sheet delivered into the tray imparting energy stored therein to the sheet effecting alignment of the sheet within the tray.

U.S Pat. No. 4,228,997 to Schoonmaker et al discloses a stacking machine for stacking random sized sheets. The sheets are received by pockets formed by adjacent flexible webs, each web being secured at one end to a disk.

U.S. Pat. No. 4,916,493 to DeVito discloses an exit roller reversal gate for a duplex printer. The gate consists of fingers which are mounted on a pivotal shaft closely adjacent to rollers. The fingers are spring loaded into an up position out of normal sheet engagement. Upon reversing of the rollers, the fingers are moved to a lower position substantially extended outside the radius of the roller to push away and hold sheets already in an exit tray from being engaged in rollers.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; well know in general and preferable to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

OBJECTS AND SUMMARY OF THE INVENTION

It is an object of the present invention to provide a disk stacker wherein entry of sheets into the disk slots is ensured and precisely controlled.

It is another object of the present invention to provide a gating system for directing sheets without slowing down the movement of the sheets.

It is another object of the present invention to provide a disk stacker which can reliably operate at high speeds with a reduced possibility of jamming.

It is a further object of the present invention to provide a disk stacker having a gating system which is capable of guiding sheets having a variety of sizes into a slot of a disk without slowing down the movement of the sheets.

To achieve the foregoing and other objects, and to overcome the shortcomings discussed above, a movable gate is provided adjacent an input position of a slotted rotatable disk for aiding in the insertion of sheets into the disk slot(s). The movable gate moves between a first position and a second position wherein the first position is closer to the disk than the second position. When in the first position, the movable gate contacts and directs the leading portion of a sheet into the disk slot. When in the second position, the movable gate does not contact the sheet. The gate is moved to the second position at least while the trailing portion of the sheet passes thereunder so that the sheet does not slow down after exiting a pair of input rollers located upstream thereof and so that the trailing portion of the sheet is free to contact an overhead trail edge transport belt.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figures 1, 1A:
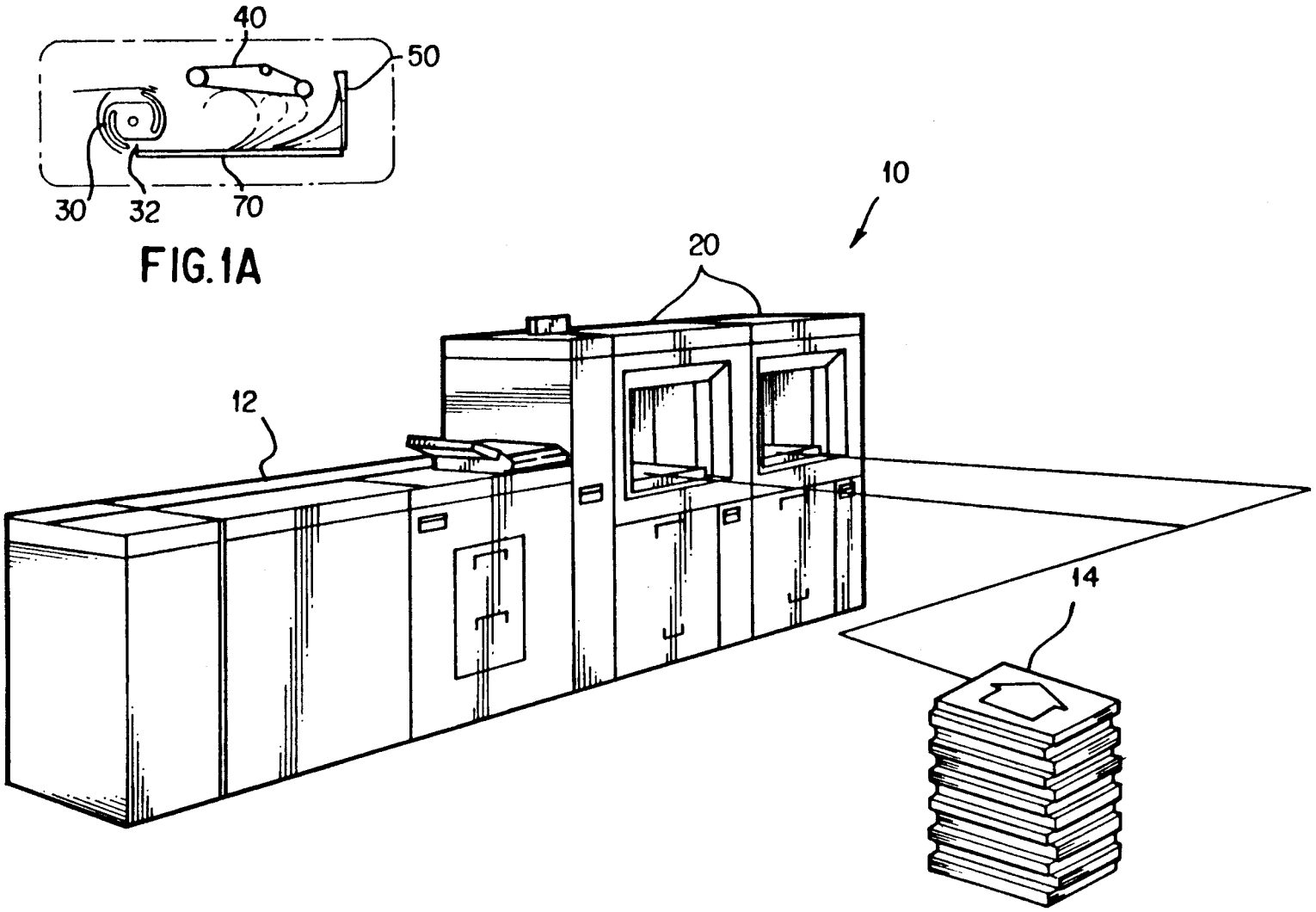
FIG. 1 is an isometric view of a document outputting device which incorporates two disk stackers according to the present invention and also illustrates a stack of documents compiled by one of the disk stackers in which individual sets of documents are offset from each other in a direction perpendicular to the process direction.
FIG. 1A is a schematical illustration of some of the generic components of the FIG. 1 disk stacker.

FIGS. 1 and 1A illustrate a feeder/stacker 10 which includes two disk stackers 20 according to the present invention. Feeder portion 12 can be, for example, a high speed copier or printer. One type of system usable as feeder portion 12 can include an optical scanner for digitizing data contained on original documents and supplying the digitized data to a high speed, high quality printer such as a laser printer which outputs documents to the disk stackers 20. Each disk stacker 20 includes a rotating disk 30 which includes one or more slots for receiving sheets therein Rotating disk 30 then rotates to invert the sheet and register the leading edge of the sheet against a registration means or wall 32 which strips the sheet from the rotatable disk 30. The sheet then drops to the top of the stack of inverted sheets which are supported on a vertically movable elevator 70. An overhead trail edge assist belt 40, to be described in more detail below, is located adjacent the rotatable disk 30 and above elevator platform 70 to assist in the inversion of sheets Elevator platform 70 is moved in a vertical direction by the actuation of a screw drive mechanism (not shown). The screw drive mechanism includes a separate, vertical, rotatable shaft having a threaded outer surface at each corner of the elevator platform and extending through a threaded aperture therein (four vertical shafts in total). As the vertical shafts are rotated, platform 70 is raised or lowered. A stack height sensor, described below, is used to control the movement of platform 70 so that the top of the stack remains at substantially the same level. An oscillating trail edge guide 50 is provided to improve the registration of the documents in the stack against registration wall 32. Each disk stacker 20 also includes a tamping mechanism (to be described in more detail below) which is capable of offsetting sets of sheets in a direction perpendicular to the process direction indicated by the arrow on top of sheet stack 14.

The provision of more than one disk stacker 20 enables sheets to be outputted at higher speeds and in a continuous fashion A specific requirement of the high speed computer printer market is the ability to provide long run capability with very minimal down time due to system failures, lack of paper supply, or lost time during unload. By providing more than one stacker, the outputting of documents need not be interrupted when one of the stackers becomes full since documents can merely be fed to the other stacker while the full stacker is unloaded. Thus, should one stacker become filled or break down, the outputting of documents is not interrupted. Furthermore, the bypass capability of each stacker enables both stackers to be bypassed so that documents can be fed to other downstream devices such as additional disk stackers or document finishing apparatus such as, for example, folding or rotating devices.

Figure 2A:
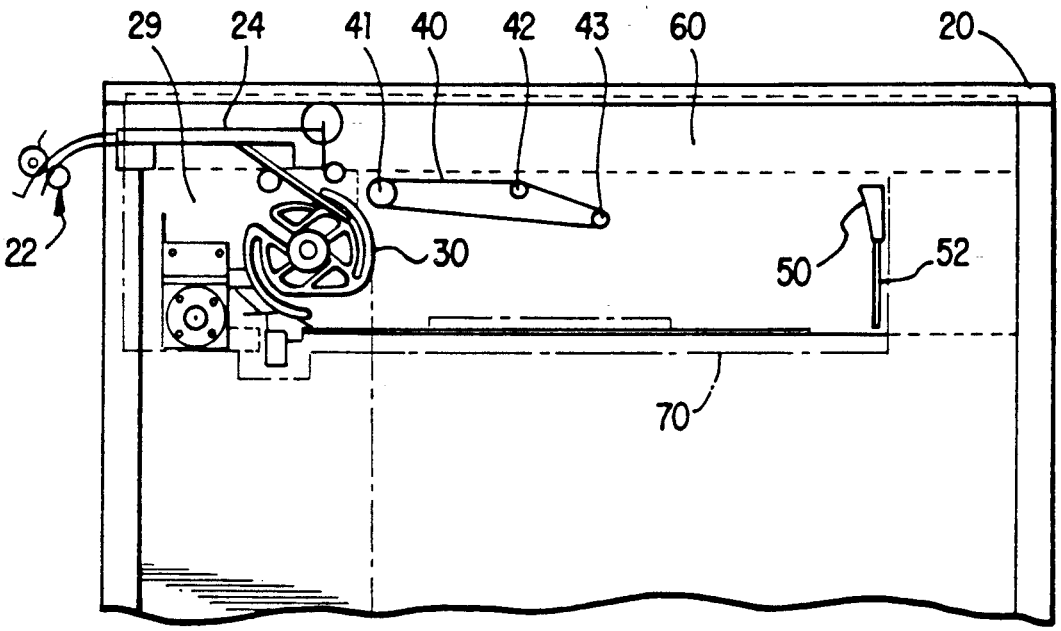
FIGS. 2A and 2B are schematic side views of a disk stacker according to one embodiment of the present invention.
Figure 2B:
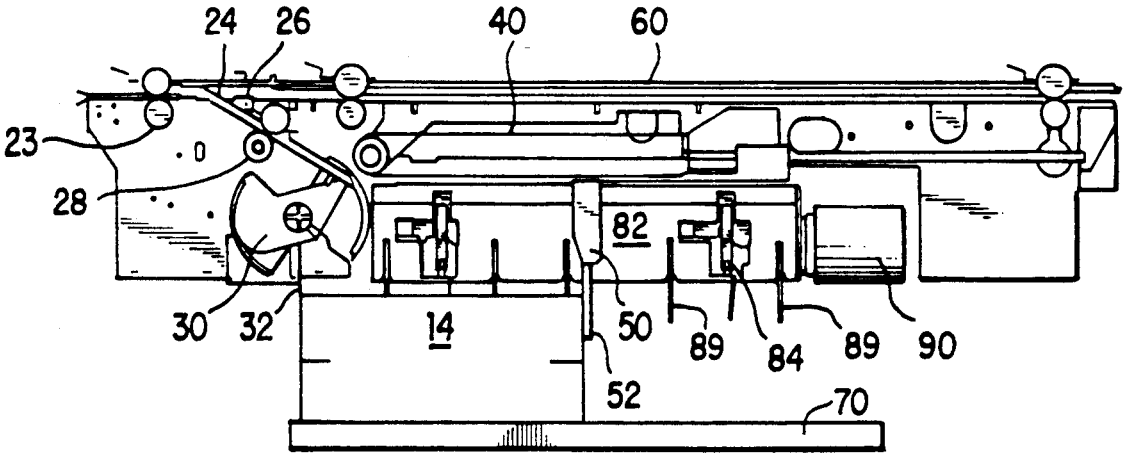
Figure 3:
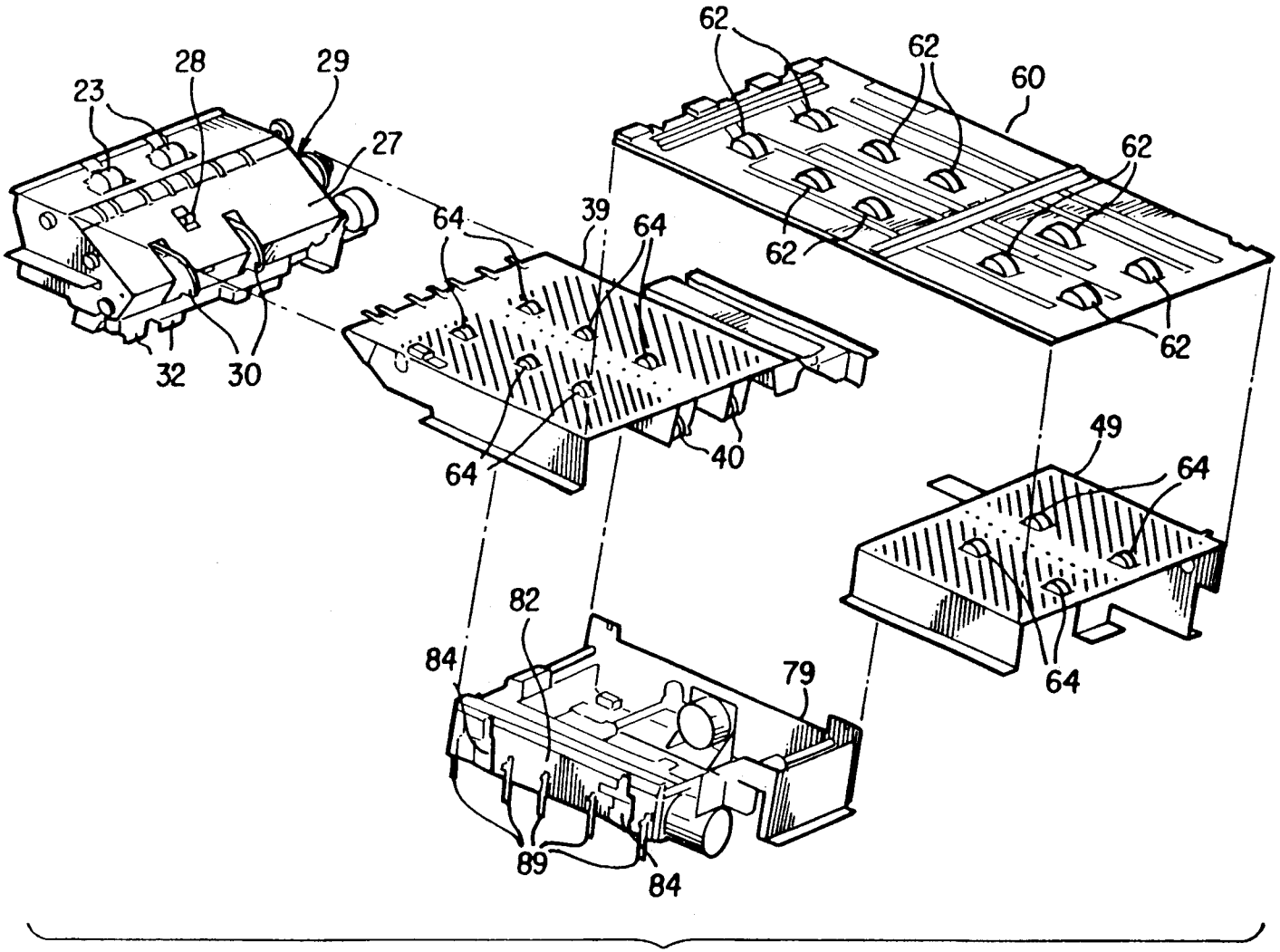
FIG. 3 is an exploded, isometric view of the disk stacker of FIGS. 2A and 2B.

FIGS. 2A, 2B and 3 illustrate the basic components of the disk stacker. Disk stacker 20 includes a disk assembly 29 which includes the rotatable disk 30 therein Disk stacker 20 also includes bypass transport idler assembly 60 which includes a plurality of pairs of bypass idler rollers 62 which engage bypass driver rollers (to be described below) to drive sheets over the sheet stacking area and to a device, such as another disk stacker or a document finishing apparatus located downstream relative to the process direction of disk stacker 20. Disk stacker 20 also includes a trail edge transport and forward bypass transport assembly 39 which includes a plurality of pairs of bypass drive rollers 64 in an upper surface thereof which engage some of the pairs of bypass idler rollers 62 to define a plurality of nips therebetween for driving sheets therethrough. A lower portion of trail edge transport and forward bypass transport assembly 39 includes one or more trail edge transport belts 40. A trail edge guide and secondary bypass transport assembly 49 includes two pairs of bypass drive rollers 64 on an upper surface thereof which engages two of the pairs of bypass idler rollers 62 to define a plurality of nips therebetween for driving sheets therethrough. A lower portion of trail edge guide and secondary bypass transport assembly 49 includes the trail edge guide 50. Trail edge guide 50 includes an oscillating member 52 which functions to register sheets on the stack 14 against front registration wall 32. Trail edge guide 50 is movably mounted to trail edge guide and secondary bypass transport assembly 49 so that sheets having different lengths can be accommodated in the disk stacker 20. FIG. 2A illustrates the position of trail edge guide 50 where large sheets such as 11×17" sheets are fed to stacking device 20, while FIG. 2B illustrates the position of trail edge guide 50 for smaller sheets such as 8½×11" sheets. Trail edge guide 50 includes an oscillation generator which causes oscillating member or plate 52 to oscillate in a direction parallel to the sheet process direction so that front edges of the uppermost sheets in the stack are tamped against front registration wall 32. Plate 52 is mounted to trail edge guide 50 so that it can shift slightly in the vertical direction and also includes one or more fingers which extend downward from a lower surface thereof to enter grooves formed in the upper surface of elevator platform 70. Such an arrangement of elements ensures that oscillating member 52 will engage even the first sheet placed on elevator platform 70.

Two tamping mechanisms 79 (one of which is illustrated in FIG. 3) are also provided for tamping the sides of the sheets on stack 14 against a side registration wall in a manner to be described below. Each tamping mechanism 79 includes a side registration wall (such as side registration wall 82 in FIGS. 2A and 3) and at least one tamper (such as tamper 84 in FIGS. 2A and 3). Each side registration wall includes a plurality of fingers 89 which extend downwardly therefrom. These fingers 89 are spring biased so that they will contact and be moved upward (against the spring bias) by elevator platform 70 when elevator platform 70 is in its uppermost position. The surface of each finger 89 which contacts the sheet stack 14 is flush with its corresponding side registration wall and thus forms an extension of its side registration wall. This arrangement ensures that there will be a good corner between each side registration wall and elevator platform 70 when platform 70 is in its uppermost position.

Platform 70 can be provided with a recess for receiving each finger 89 so that the lowest portion of each finger 89 will be located below the upper surface of elevator platform 70. The recess prevents the first few sheets which are placed on platform 70 from being pinched between the lowest portion of each finger 89 and the upper surface of platform 70. It is also possible to extend each side registration wall downward and provide an aperture in platform 70 through which the lower end of each side registration wall extends when platform 70 is in its uppermost position. However, since the side registration walls of the present invention are movable in a direction transverse to the sheet process direction to adjust for different sheet sizes, a plurality of holes or one large hole would be required in elevator platform 70 for each side registration wall to receive the lower end of each side registration wall at the plurality of positions at which it may be located. These holes tend to reduce the strength and durability of the elevator platform. With the present invention which includes a plurality of fingers 89 which are received in recesses formed in elevator platform 70, no holes are required in elevator platform 70. Instead, an elongated recess is formed in the upper surface of platform 70 for each finger 89. Each recess extends across at least a portion of platform 70 in a direction transverse to the sheet process direction to receive its corresponding finger regardless of the location of its side registration wall. The recesses in platform 70 actually function to strengthen platform 70 by providing reinforcement therefor.

Before entering disk stacker 20, the sheets exit through output rollers 22 of an upstream device. The upstream device could be a printer, copier, other disk stacker, or a device for rotating sheets. Sheets may need to be rotated so that they have a certain orientation after being inverted by disk 30. The sheets can enter disk stacker 20 long edge first or short edge first. After entering stacker 20, the sheet enters predisk transport 24 where the sheet is engaged by the nip formed between one or more pairs of disk stacker input rollers 23. If a bypass signal is provided, bypass deflector gate 26 moves downward to deflect the sheet into bypass transport assembly 60 If no bypass signal is provided, the sheet is directed to disk input rollers 28 which constitute part of the feeding means for feeding sheets to an input position (shown in FIGS. 2A and 2B) of disk 30.

The movement of disk 30 can be controlled by a variety of means conventional in the art. Preferably, a sensor located upstream of disk 30 detects the presence of a sheet approaching disk 30. Since disk input roller 28 operates at a constant first velocity, the time required for the lead edge of the sheet to reach the disk slot is known. As the lead edge of the sheet begins to enter the slot, the disk rotates through a 180° cycle. The disk 30 is rotated at a peripheral velocity which is about ½ the velocity of input roller 28 so that the leading edge of the sheet progressively enters the disk slot. However, the disk 30 is rotated at an appropriate speed so that the leading edge of the sheet contacts registration wall 32 prior to contacting the end of the slot. This reduces the possibility of damage to the lead edge of the sheet. Such a manner of control is disclosed in above-incorporated U.S. Pat. No. 4,431,177 to Beery et al.

One advantageous feature of the present invention involves the construction and operation of trail edge transport belt 40. As opposed to previous systems which utilized a trail edge transport belt which operates at the same velocity as the feeding means which inputs sheets into the rotatable disk, the present invention includes a trail edge assist belt 40 which is rotated at a velocity which is greater than the velocity at which feeding means (which includes feed roller 23 and 28) is operated. Preferably, transport belt 40 is rotated at a velocity which is 1.5 times the velocity of the feeding means. Additionally, trail edge transport belt 40 is arranged at an angle to elevator platform 70 so that a distance between the transport belt and elevator platform 70 decreases as the transport belt 40 extends away from rotatable disk 30. Three pulleys 41, 42 and 43, at least one of which is driven by a motor (not shown) maintain tension on transport belt 40 and cause transport belt 40 to rotate at a velocity which is greater than that of the feeding means. The transport belt 40 is arranged at an angle in the range between 5 and 30° to the planar surface of elevator 70. Thus, when elevator platform 70 is a horizontally arranged tray, a plane defined by the portion of transport belt 40 which contacts the trailing portion of the sheet slopes downwardly as it extends away from rotatable disk 30. The velocity and arrangement of trail edge assist transport 40 prevents long, light weight sheets from collapsing before they are entirely inverted and also prevents heavier weight sheets from stubbing on the overhead bypass mechanism 60 and other overhead components of disk stacker 20. In particular, it has been found that operating trail edge transport belt 40 at a higher speed than the feeding rollers 28 and at an angle to elevator platform 70 prevents long, light weight sheets from collapsing on themselves prior to being entirely inverted. Increasing the speed of transport belt 40 increases the energy which is imparted to the trail edge of the sheet to help keep the sheet in contact with belt 40 until the entire sheet is inverted. By angling belts 40 so that they are closer to platform 70 as they extend from disk 30, contact between the belts and sheets are also improved because the belt 40 follows the path which the sheet desires to follow (i.e., the angle of belt 40 compensates for sheet drooping).

Figure 4:
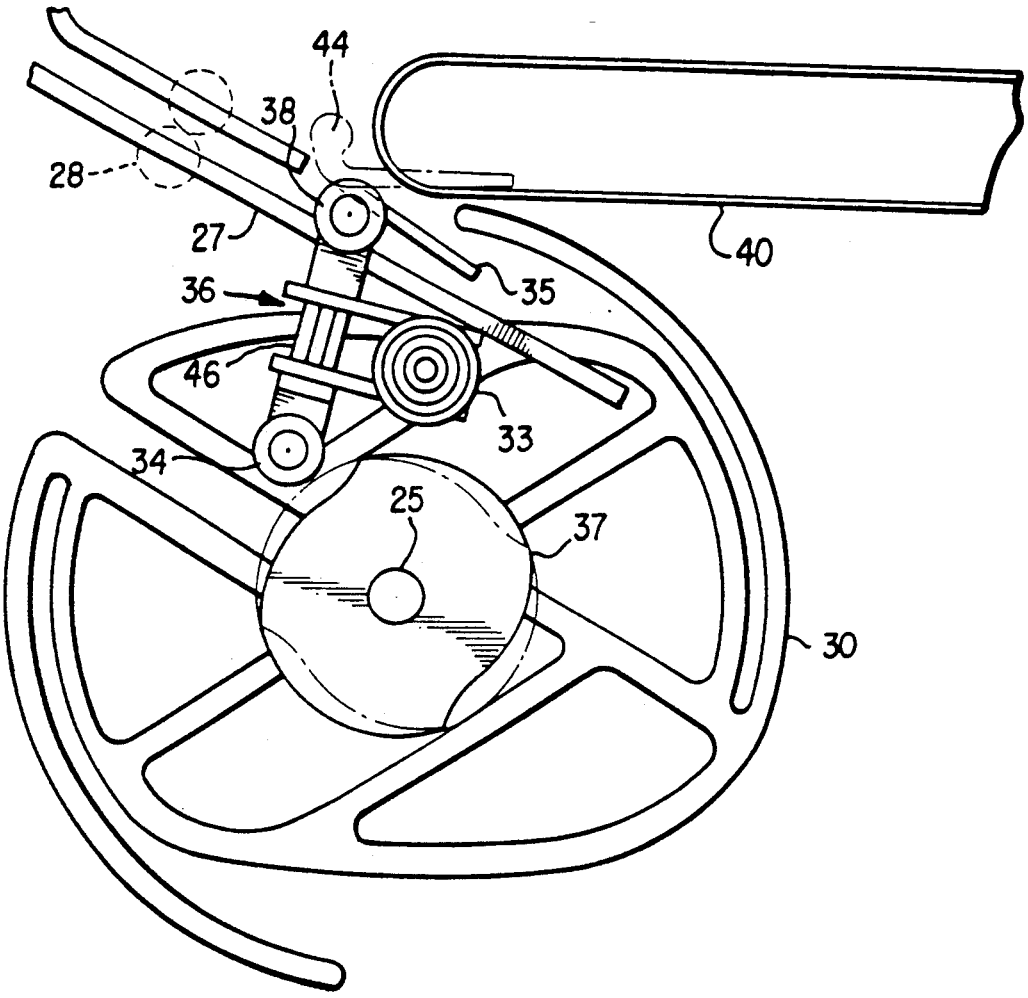
FIG. 4 is a side view of a rotatable disk and movable gate which assists in the insertion of sheets into the slots of the rotatable disk.

FIG. 4 is a schematic side view of a movable gate which is used to assist in the insertion of sheets into rotatable disk 30. When operating at high speeds, it is difficult to ensure that sheets will be fed directly from disk input rollers 28 along disk entry guide plate 27 and into one of the slots of rotatable disk 30. The leading edge of a sheet may be curled or may be lifted by air, especially when conveyed at high speeds, to interfere with the insertion of the sheet into the disk slot. While fixed position gates have been provided to assist in directing sheets into the disk slot, these fixed position gates prevent the trailing edge of the sheet from contacting trail edge transport belt 40 as early as possible. Even more importantly, since fixed position gates contact the sheet along its entire length, they apply friction to and slow down the trail edge of the sheet after it is released from disk input rollers 28. After being released from disk input rollers 28, the sheet is not being positively conveyed by any driving mechanism and therefore its forward movement depends upon the momentum of the sheet. Thus, it is seen how a fixed position gate will slow down sheets after their trailing portion exits disk input rollers 28. When operating at high speeds a fixed position gate tends to create jams at the location of the rotatable disk because the trail edge of a sheet which is slowed down by the gate interferes with the leading edge of a subsequent sheet being fed through disk input rollers 28.

The present disk stacker 20 uses a movable gate 35 which is positioned adjacent rotatable disk 30 at an input position thereof and is movable between a first position, illustrated by solid lines, and a second position illustrated by broken lines. The first position is closer to rotatable disk 30 than the second position so that when in the first position, movable gate 35 contacts the sheet and assists in the insertion of the sheet into the disk slot, while in the second position, movable gate 35 is located above and out of the feed path of the sheet so as not to contact the trailing edge of the sheet. Furthermore, since it is desirable for the trail edge transport 40 to contact the sheet as soon as possible, trail edge transport 40 is located on a side of rotatable disk 30 opposite from feeding means 28 closely adjacent the input position of disk 30 and the movable gate 35 is located above the plane defined by the lower-most portion of transport belt 40 so that it does not interfere with the contact between the trailing portion of the sheet and transport belt 40.

Figure 5:
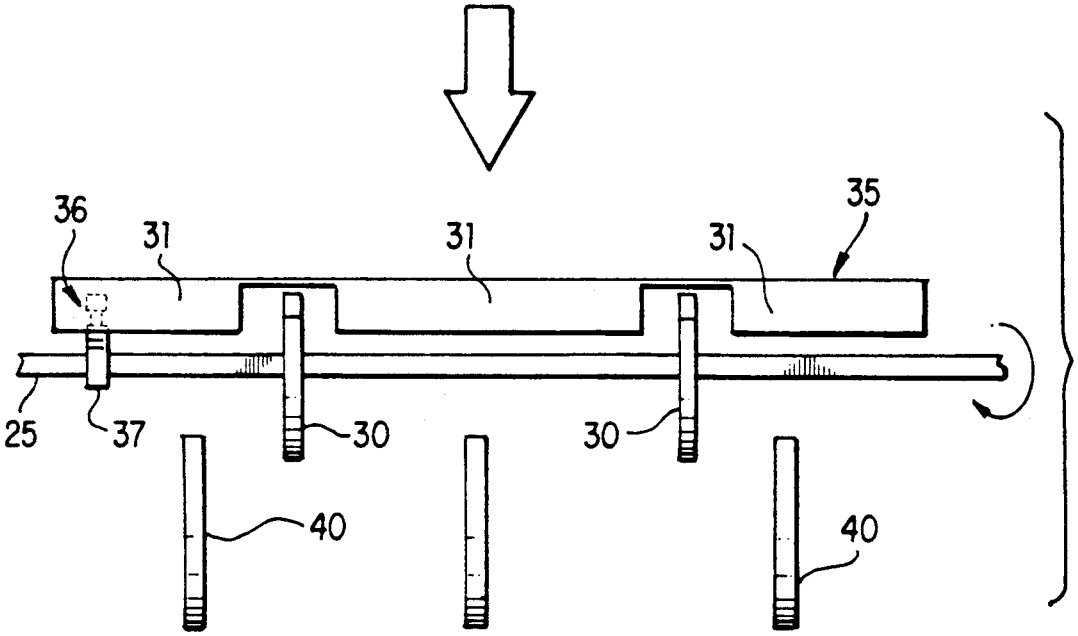
FIG. 5 is a schematic overhead view of the movable gate, rotatable disks and trail edge transfer belts of FIG. 4.

FIGS. 4 and 5 illustrate one possible means for moving gate 35 between the first and second positions. Movable gate includes an elongated member which extends across the paper feed path in a direction which is transverse to the process direction. The elongated member includes a plurality of fingers 31 extending outwardly from one side thereof, an opposite side of the elongated member being pivotally mounted to a support at pivot point 44. A spring can be provided to bias gate 35 towards the first position. While the movement of gate 35 can be controlled electronically, a very simple and reliable means for moving the gate is to include a cam 37 on shaft 25 which rotates disks 30. Cam 37 illustrated in the figures is usable with a rotatable disk 30 which includes two diametrically opposed slots thereon. Thus, the cam surface includes two similarly shaped portions, each of which extends around 180° of the cam for controlling the motion of movable gate 35 for one sheet conveying cycle of rotatable disk 30 (a sheet conveying cycle involves rotating disk 30 through 180°). Each 180° portion of the cam surface of cam 37 includes first and second subportions. A first sub-portion includes a surface which is located closer to a center of the cam than a surface of a second sub-portion so that gate 35 is in its first position when cam follower 36 contacts the first subportion and is in its second position when cam follower 36 contacts its second sub-portion FIG. 4 illustrates the location of cam 37 and gate 35 relative to rotatable disk 30 when in its input position in solid line while illustrating the position of gate 35 and cam 37 when gate 35 is in the second position in broken lines.

Follower 36 can have a variety of constructions In the embodiment illustrated in FIG. 4, follower 36 includes a main body portion 46 having a cam follower roller 34 at one end thereof which contacts the surface of cam 37 and a gate follower roller 38 at a second there end thereof which contacts movable gate 35. The body 46 of follower 36 is slidably connected to a support (not shown) by mounting member 33. Thus, it is seen how the movement of gate 35 can be precisely timed to the rotation of disk 30 because its movement is controlled by the surface of cam 37 which is linked to disk 30.

A special mode of operation is used to control the rotation of disk 30 and thus the movement of gate 35 when long sheets are being rotated. If exceptionally long sheets (e.g., 11×17" sheets) were inverted by rotating disk 30 through the 180° cycle used for smaller sheets, gate 35 would drop to its first, or lower, position while the trailing portion of the longer sheet was still located beneath gate 35. Gate 35 would contact the trailing portion of the sheet and slow down the sheet as described above. To prevent gate 35 from dropping before a long sheet is conveyed past gate 35, the rotation of disk 30 is paused momentarily so that the second sub-portion (the raised sub-portion) of cam 37 continues to engage follower 46 and maintain gate 35 in the first position. Once the trailing edge of the sheet passes beneath gate 35, the 180° rotation cycle of disk 30 is completed. The length of the sheets approaching disk 30 can be detected by sensors which are well known in the art and, if the detected sheet length is greater than a predetermined length, the above-identified special mode of operation will take place.

Figure 6A:
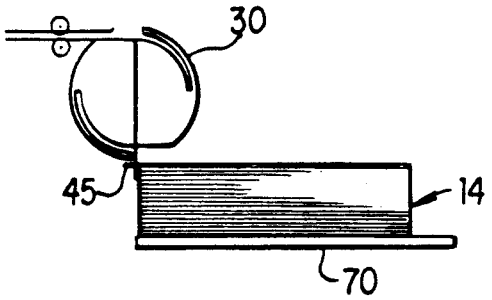
FIGS. 6A and 6B are side and front views, respectively, of a disk stacker illustrating the location of a stack height sensor used therewith.
Figure 6B:
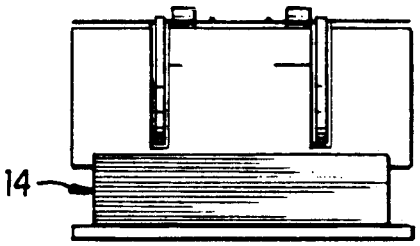
Figure 7:
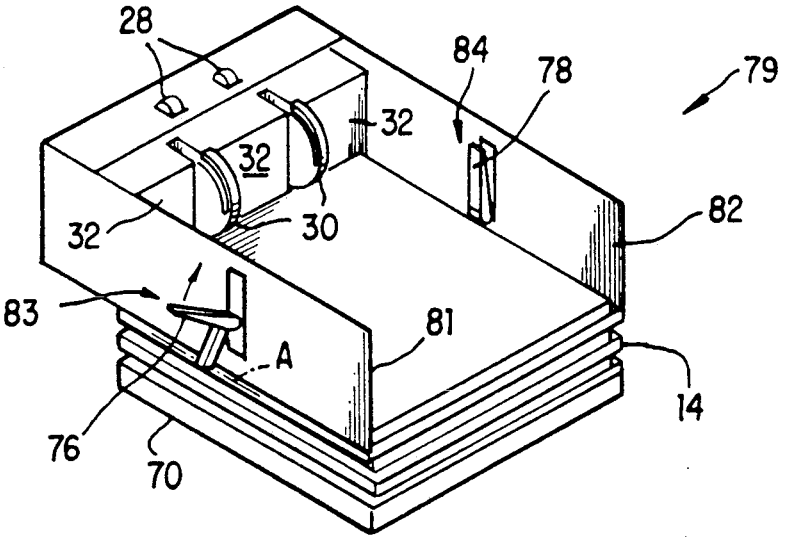
FIG. 7 is a schematic isometric view of the offsetting mechanism usable with the present invention.

The area of disk stacker 20 which receives inverted sheets from rotatable disks 30, includes a pair of side registration walls 81, 82 against which side edges of the sheets are registered in addition to elevator platform 70, registration wall 32 which contacts the lead edge of a sheet, and trail edge guide 50 which contacts the trail edge of a sheet. Side registration walls 81, 82 can be fixed relative to front registration wall 32 (as shown in FIG. 7) or laterally movable (as shown in FIGS. 2B and 3) so that sheets having a variety of widths can be located between side registration walls 81 and 82. A tamping mechanism 79 is provided to tamp sheets against one of the side registration walls 81, 82 so that the side edges of all of the sheets are appropriately aligned. The present invention provides a tamping mechanism 79 which is capable of tamping the side edges of different sheets against one or the other of side registration walls 81, 82 so that sets of sheets can be offset from one another in a direction transverse to the process direction. Tamping mechanism 79 includes first and second tampers 83, 84, respectively, each of which includes a tamping finger 76, 78, respectively, that individually moves through apertures located in first and second side registration walls 81, 82, respectively, between an active position wherein the tamper is extended through its respective registration wall aperture and located above a surface of the sheet stack 14 to tamp incoming sheets against the opposed side registration wall, and an inactive position wherein the tamper is retracted behind its respective side registration wall out of an area between the first and second registration walls 81, 82. FIGS. 6A and 6B illustrate the location of a height sensor 45 which is used to maintain the top of the stack of sheets spaced a predetermined distance below a lower-most portion of rotatable disk 30 as well as tampers 83 and 84 so that sheets which have settled to the top of the stack are not interfered with by either the rotatable disks 30 or the tampers 83 and 84. Preferably, the top of the sheet stack is spaced from the lower-most portion of rotatable disk 30 so that sheets will fall freely before coming to rest on the top of sheet stack 14. The amount of free fall is not critical as long as sheets are permitted to fall freely some distance onto the top of the stack and be acted upon by the tampers and trail edge guide. The amount of free fall can be, for example, 15 millimeters but this distance is meant to be illustrative only, not limiting.

In operation, one tamper, for example tamper 84, actively tamps a side of the incoming sheets with its tamping finger 78 while the other tamper, for example tamper 83, is inactive and retracted behind registration wall 81. A sheet of paper, after inversion in disk 30, arrives at the tamper location and is centrally positioned between the registration walls 81, 82. The active tamper acts to push the sheet to the opposite registration wall by moving its tamping finger between the positions shown in FIG. 8B. Each tamping finger can be provided with its own oscillating means for causing the finger to oscillate, or a common oscillating means can be provided for all of the tamping fingers provided with each respective side registration wall. The oscillating means preferably moves each tamping finger between a first position wherein the finger extends vertically at an angle of substantially 90° to an upper surface of the sheet stack to contact a side edge of a sheet, and a second position wherein the finger extends at an obtuse angle to the upper surface of the stack. However, other motions can also be used. The oscillating means preferably includes a shaft having an eccentric thereon which is linked to a tamping finger to cause it to oscillate as described above. However other mechanisms can also be used for oscillating means. One or more tampers can be provided for each side registration wall 81, 82 and the actual number of times which the tamping finger tamps on the edge of each sheet may vary widely. The sheet remains captured between the tamper and opposing registration wall as it settles to the top of the sheet stack, guarding against loss of registration. This offsetting and registration activity continues for the duration of a given set. At the end of the set, after the last sheet settles out and before the first sheet of the next set arrives, the tamper is retracted behind the registration wall and the opposite tamper is extended into position. The next set is then compiled and the process repeats. It should be noted that the tamper extends into position from above the stack by pivoting about axis A (see FIG. 7) in the direction of the arrow in such a fashion that the top sheets are not disturbed in the event they are not yet settled out. A mechanism 90 is used to pivotally rotate tampers (e.g., tampers 84) away from the sheet receiving zone and behind side registration wall 82. The mechanism for pivoting the tampers can include, for example, a linkage, attached at one end to the tamping finger, and attached at an opposite end to a clutch which is rotated 180° to move the tamper to its extended position (between side registration walls 81, 82) and is rotated another 180° to move tamper to its retracted position behind its respective side registration wall. However, other types of movement and mechanisms for retracting and extending tampers 83 and 84 can also be provided.

At higher speeds, sheets may not be fully settled when the next sheet arrives. At the set exchange event, registration of the last sheet(s) may be lost if the tamper is retracted before the sheet settles out. A method of maintaining the registration of the last sheet(s) of a set while preparing for the first sheet of the next set involves the relational timing of the tamper exchange. Rather than retract the active tamper and extend the inactive tamper simultaneously, the active tamper is left in place when the inactive tamper is extended. Thus, the extended tamper is in position to act on the first sheet of the next set, while the previous tamper is still maintaining the registration of the previous sheet(s) as it (they) settle out. When the first sheet of the next set arrives, it is momentarily contained between both extended tampers. After a predetermined period of time has elapsed (long enough for the previous sheet(s) to finish settling), the previously active tamper is retracted and the new sheet is allowed to fully offset and register.

Figure 8A:
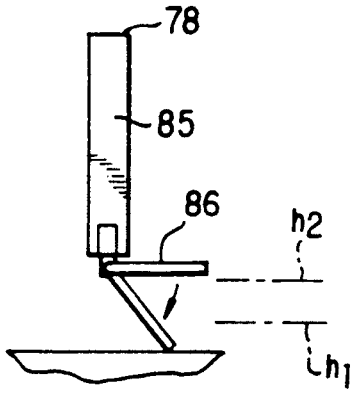
FIGS. 8A and 8B are front and side views, respectively, of a tamping finger and pivoting gate which are part of the tamping mechanism of FIG. 7.
Figure 8B:
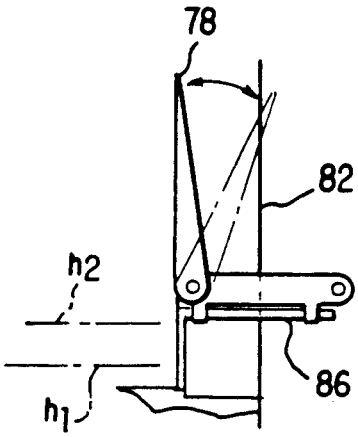

A pivoting gate member or scatter guard 86 is provided to prevent previously registered sheets from moving out of place. FIGS. 8A and 8B illustrate the functioning of scatter guard 86. Typically, the lead edge of the stack is used when sensing the stack height in an effort to control the relationship of the stack to the disks 30. This is why height sensor 45 is preferably located behind registration wall 32 as illustrated in FIG. 6A. Such an arrangement implies that the remainder of the top of the stack may not be at the same height as the lead edge. This is likely because of curled paper and/or image build-up. This presents a potential problem to the tamping mechanism in the following way. If the stack is too high at the location of the tamper, the tamper may not be able to fully extend into position. If the stack is too low, the sheets may slide out under the tamper thus losing registration. A means of solving this problem is to position the tamping mechanism at a height just above the highest expected stack condition indicated by line $h_2$. A pivoting member or gate 86 is attached to the tamper 84 to maintain the registration of the sheets after they are tamped and fall below the tamper. The gate, or scatter guard 86, is free to fall to the top of a stack, thus providing full containment of the sheets being offset. In addition, since the gate is long enough to fall to a stack height that is abnormally low (indicated by line $h_1$) latitude is improved for low stacks as Well At the set exchange event, the gate is pulled up first by rotating in a direction opposite of the arrow shown in FIG. 8A, then the tamper 84 is retracted. On the opposite side, the extending tamper is first extended, then the gate is allowed to pivot to the top of the stack. The scatter guard 86 is attached to its respective tamping finger so that it is moved between the side registration walls 81, 82 or behind its respective side registration wall with its tamping finger Scatter guard 86 is linked to the mechanism for moving its tamper between the retracted and extended positions by, for example, a cam so that the scatter guard 86 falls to the top of the stack after tamper is extended and is pivoted upward away from the stack prior to movement of the tamper to its retracted position. Since each tamper pivots to its retracted position, it is apparent that the scatter guard 86 must be raised prior to rotating tamper or else the scatter guard will "kick" previously stacked sheets out of registration. This problem is prevented by providing a delay mechanism in the linkage which moves the tamper between its extended and retracted positions so that the scatter guard 86 is raised prior to the start of tamper rotation. Obviously, if the mechanism which moves the tampers between the extended and retracted positions did so with a linear (instead of pivotal) movement, the "kick" problem would not occur.

Figure 9A:
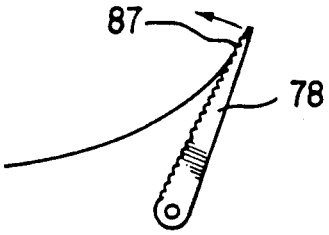
FIG. 9A is a side view of a tamping finger including a plurality of teeth thereon.
Figure 9B:
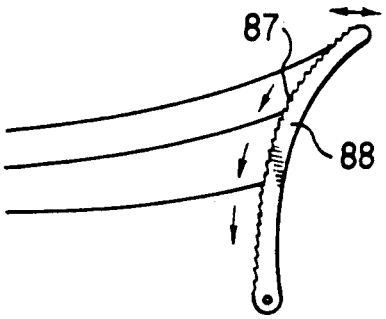
FIG. 9B is a side view of a curved tamping finger including a plurality of teeth thereon which is oscillated at a high frequency through a low amplitude.

Another means for improving the performance of the tampers, illustrated in FIG. 9A, is to provide a plurality of teeth 87 on the sheet contacting face 85 of each tamping finger. These teeth catch the edge of the sheet more firmly when a sheet lays in a tangential manner on the tamper face 85. Typically, the lower the beam strength of the sheet of paper, the greater the tendency to lay tangentially on the tamper face. Without the teeth, sheets may ride up on the face as the tamper attempts to push it if the frictional force or electrostatic attraction between the sheet and the previous sheet is too great. The teeth 87 ensure that the side edge of a sheet will not ride up on the sheet contacting face 85 of the tamping finger.

Two alternative tamping motions can be provided for the tampers. If a substantially planar tamper is used, the tamper is frequently moved at a relatively low frequency through a relatively high amplitude as shown in FIG. 9A. A "vibrating" tamper can alternatively be provided which is moved at a high frequency through a low amplitude. Such a tamping finger 88 has a curved sheet contacting face with a plurality of teeth 87 thereon. As a sheet is acted upon, it is moved in a rapid series of small steps until it reaches the opposite registration wall. The advantage of this approach is the potentially significant reduction in parts necessary to achieve the vibration since piezo-electric devices can be used to provide the oscillation.

Figure 10:
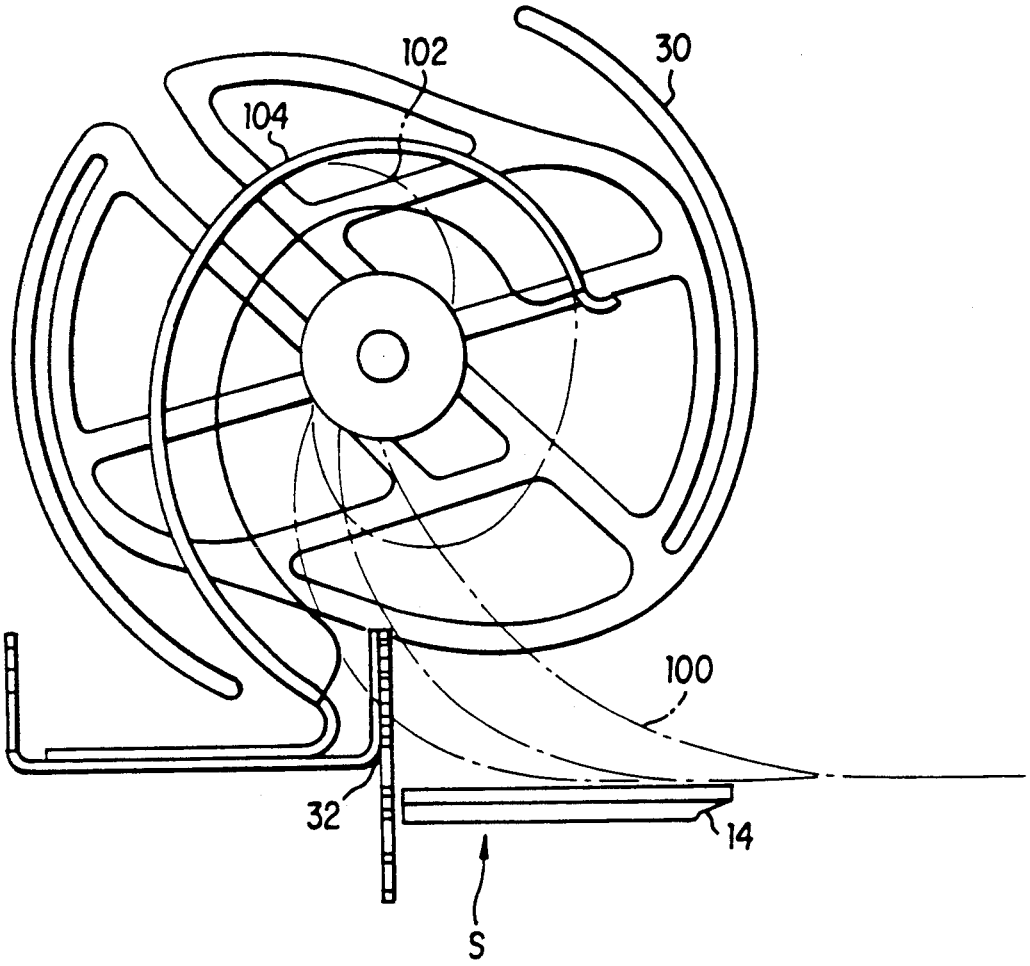
FIG. 10 is a side view of a rotatable disk which incorporates an elongated flexible wiping member for contacting and forcing the top sheet in the stack against the front registration wall of the disk stacker.

FIG. 10 is a side view of a wiper means which can be used with the present invention. This wiper means is particularly useful when sheets are being fed at high speeds. Sheets fed at high speeds tend to bounce away from registration wall 32 so that the front edge of the stack is uneven. Even though trail edge guide 50 is oscillating against the rear edge of each sheet, it has been found that the front edge of the stack is still not satisfactorily even. Wiper means is used to force each sheet against front registration wall 32 after being released by the disk 30 and re-register sheets which have bounced away from front registration wall 32. Wiper means moves in timed relation to rotatable disk 30 by being attached directly to the rotatable disk or to the shaft 25 which rotates disk 30. Preferably, wiper means is a wiping member 100 which is attached at one end to shaft 25 and includes a second end which is free to engage a sheet near the output position of the rotatable disk 30. Wiping member 100 is very flexible and is preferably made from a material such as mylar. The second end of wiping member 100 which contacts the sheets preferably has a surface made from a material having a high coefficient of friction, such as, for example, rubber. Wiping member 100 has a length so that the second end thereof is capable of extending radially outward beyond the slot of the disk and, in the preferred embodiment, beyond the diameter of disk 30 so as to contact the uppermost sheet of the stack. Preferably, wiping member 100 is made long enough to contact the upper sheet on the stack as long as possible prior to the next sheet being registered against registration wall 32. Wiping member 100 must exit the output area before the next sheet arrives so as not to interfere with the stripping of the next sheet from the disk slot by registration wall 32.

The location of wiping member 100 is controlled by a constraining means which, in the preferred embodiment is a retaining wall 104 which is spaced from and extends partially around shaft 25 along a plane perpendicular to an axis of shaft 25. The wiping member 100 is located in the same plane as retaining wall 104 so that it is constrained within a diameter of disk 30 for a portion of its rotation to prevent member 100 from interfering with the inputting of sheets into the disk slot. Retaining wall 104 also functions to wind-up the wiping member 100 so that when released from retaining wall 104, the energy stored in wiping member 100 is transferred to the sheet resulting in forces being generated to ensure that the sheet is stacked and maintained in its desired position on the stack 14. The exact amount of contact as well as the timing of contact between wiping member 100 and the top sheet on the stack can be controlled by varying the length, thickness or shape of wiping member 100 and/or the shape of retaining wall 104. While wiping member 100 must exit the output area prior to the arrival of a subsequent sheet thereto, the retaining wall 104 can be shaped so that it releases wiping member 101 at a variety of positions. For example, wiping member 100 can be released from retaining wall 104 so that it contacts a sheet while the sheet is at least partially in the disk slot before or after registration means 32 begins stripping the sheet from the slot. Additionally, retaining wall 104 can be shaped so that it does not release wiping member 100 until after the sheet has been entirely stripped from the slot of disk 30 by registration means 32. Since the preferred rotatable disk 30 includes two diametrically opposed slots therein, a second wiping member 102 is also provided and is attached to either the shaft 25 or rotatable disk 30 at a position diametrically opposed from the attachment of wiping member 100.

While the present invention is described with reference to a preferred embodiment, this particular preferred embodiment is intended to be illustrative, not limiting. Various modifications may be made without departing from the spirit and scope of the invention as defined by the appended claims.

What is claimed is:

1. A disk stacker for receiving and inverting sheets, comprising:

a rotatable disk including at least one slot for receiving a sheet therein;

rotating means for rotating said rotatable disk;

feeding means for feeding a sheet from a sheet supply to said slot of said rotatable disk, said rotatable disk being capable of receiving a sheet insaid slot when located at an input position, and inverting the sheet by rotating;

a movable gate positioned adjacent to said rotatable disk at said input position, and being movable between first and second positions, said first position being closer to said rotatable disk than said second position,; and moving means for moving said gate between said first and second positions in synchronism with rotation of said rotatable disk, wherein said moving means moves said movable gate to said fist position every time said disk is at said input positions that said gate contacts and assists a sheet for insertion of the sheet into said slot, said moving means moving said gate to said second position upon rotation of said disk from said input position, so that said gate does not contact a trailing portion of the sheet.

2. A disk stacker for receiving and inverting sheets, comprising:

a rotatable disk including at least one slot for receiving a sheet therein;

rotating means for rotating said rotatable disk;

a shaft, said rotatable disk being mounted on said shaft, said shaft being attached to aid rotating means o that said rotating means rotates said rotatable disk by rotating said shaft;

feeding means for feeding a sheet from a sheet supply to said slot of said rotatable disk, said rotatable disk being capable of receiving a sheet insaid slot when located at an input position, and inverting the sheet by rotating;

a movable gate positioned adjacent to said rotatable disk at said input position, and being movable between first and second positions, said first position being closer to said rotatable disk than said second position; and moving means for moving the gate between said first and second positions, said moving means including a cam, mounted on said shaft and having a cam surface, and a cam follower attached between said cam surface and said movable gate, said cam follower moving said movable gate between said first and second positions as said shaft and camera rotated by said rotating means, wherein said moving means moves said movable gate to said first position when said disk as is at said input position so that said gate contacts and assists a sheet for insertion of the sheet into said slot, said moving means moving said gate to said second position upon rotation of said disk from said input position.

3. The disk stacker according to claim 2, wherein said feeding means feeds the sheets along a feed path in a process direction and said movable gate includes an elongated member which extends across the paper feed path in a direction which is transverse to the process direction, said elongated member having a plurality of fingers which extend outwardly from one side thereof, an opposite side of said elongated member being pivotally mounted to a support, said cam follower being in contact with an end portion of said elongated member, whereby said elongated member is moved between said first and second positions by said cam follower by pivoting about said opposite side thereof, said plurality of fingers contacting the sheet when in said first position.

4. The apparatus according to claim 2, wherein said rotatable disk includes two diametrically opposed slots and said cam surface includes two similarly shaped portions, each portion extending around 180° of said cam and including first and second sub-portions, said first sub-portion having a surface which is located closer to a center of said cam than a surface of said second subportion so that said gate is in said first position when said cam follower contacts said first sub-portion and is in said second position when said cam follower contacts said second sub-portion, said rotatable disk being capable of individually inverting two sheets upon being rotated 360°.

5. The disk stacker according to claim 1, wherein said feeding means feeds the sheets along a feed path in a process direction and said movable gate includes an elongated member which extends across the paper feed path in a direction which is transverse to the process direction, said elongated member having a plurality of fingers which extend outwardly from one side thereof, an opposite side of said elongated member being pivotally mounted to a support, whereby said elongated member moves between said first and second positions by pivoting about said opposite side thereof, said plurality of fingers contacting the sheet when in said first position.

6. The disk stacker according to claim 1, wherein said feeding means includes at least one pair of feed rollers which define a nip therebetween for moving a sheet in a process direction, said at least one pair of feed rollers being located upstream of said movable gate relative to said process direction, said moving means locating said movable gate at said second position at least during a time period when a trail edge of a sheet is located in an area between said feed rollers and said movable gate.

7. The disk stacker according to claim 2, further comprising:

sensing means for sensing the length of sheets being fed to said disk stacker, said rotating means momentarily stopping the rotation of said rotatable disk means during a rotation cycle thereof so that said movable gate remains in said second position until after a trailing edge of the sheet passes said movable gate when the sensed length of the sheet is greater than a predetermined length.

8. The disk stacker according to claim 1, further comprising:

a transport belt, located on a side of said rotatable disk opposite from said feeding means, for engaging and driving a trailing portion of a sheet as the sheet is inverted by said disk to ensure inversion of the sheet, said transport belt defining a plane in which a portion of an endless loop defined by said belt which contacts the trailing portion of the sheet extends, said transport belt being located closely adjacent to said input position, wherein said movable gate is located above said plane when in said second position so that the movable gate does not interfere with the contact between the trailing portion of the sheet and said transport belt.

9. A disk stacker for receiving and inverting sheets, comprising:

a rotatable disk including at least ones lot for receiving a sheet therein;

rotating means for rotating said rotatable disk;

feeding means for feeding a sheet along a feed path in a process direction from a sheet supply to said slot of said rotatable disk, said rotatable disk being capable of receiving a sheet in said slot when said slot is located with an inlet thereof adjacent to said feeding means, and inverting the sheet by rotating, and asset means, which moves in synchronism with rotation of said rotatable disk and is located downstream of said feeding means relative to the process direction, for contacting only a leading portion of each sheet so as to o direct the leading portion of each sheet into said rotatable disk slot without contacting or interfering with movement of a trailing edge of each sheet.

10. The disk stacker according to claim 9, wherein said assist means includes:

an elongated member which extends across the paper feed path transverse to the process direction, said elongated member having a plurality of fingers which extend outwardly from one side thereof, an opposite side of said elongated member being pivotally mounted to a support, said elongated member being pivotally mounted to a support, said elongated member being movable between a first, lower position and a second, upper position, said first position being closer to said rotatable disk than said second position so that said elongated member contacts the sheet only when in said first position; and moving means for moving said elongated member between said first and second positions.

11. The disk stacker according to claim 10, further comprising:

a shaft, said rotatable disk being mounted on said shaft, said shaft being attached to said rotating means so that said rotating means rotates said rotatable disk by rotating said shaft;

wherein said moving means includes a cam, mounted on said shaft and having a cam surface, and a cam follower attached between said cam surface and said movable gate, said cam follower moving said movable gate between said first and second positions as said shaft and cam are rotated by said rotating means.

12. The apparatus according to claim 11, wherein said rotatable disk includes two diametrically opposed slots and said cam surface includes two similarly shaped portions, each portion extending around 180° of said cam and including first and second sub-portions, said first sub-portion having a surface which is located closer to a center of said cam than a surface of said second subportion so that said gate is in said first position when said cam follower contacts said first sub-portion and is in said second position when said cam follower contacts said second sub-portion, said rotatable disk being capable of individually inverting two sheets upon being rotated 360°.

13. The disk stacker according to claim 11, further comprising:

sensing means for sensing the length of sheets being fed to said disk stacker, said rotating means momentarily stopping the rotation of said rotatable disk means during a rotation cycle thereof so that said movable gate remains in said second position until after a trailing edge of the sheet passes said movable gate when the sensed length of the sheet is greater than a predetermined length.

14. The disk stacker according to claim 9, wherein said feeding means includes at least one pair of feed rollers which define a nip therebetween for moving a sheet in a process direction, said at least one pair of feed rollers being located upstream of said movable gate relative to said process direction, said moving means locating said movable gate at said second position at least during a time period when a trail edge of a sheet is located in an area between said feed rollers and said movable gate.

15. The disk stacker according to claim 9, further comprising:

a transport belt, located on a side of said rotatable disk opposite from said feeding means, for engaging and driving a trailing portion of a sheet as the sheet is inverted by said disk to ensure inversion of the she-et, said transport belt defining a plane in which a portion of an endless loop defined by said belt which contacts the trailing portion of the sheet extends, said transport belt being located closely adjacent to said input position, wherein said movable gate is located above said plane when in said second position so that said movable gate does not interfere with the contact between the trailing portion of the sheet and said transport belt.

* * * * *